US007712630B2

(12) United States Patent
He

(10) Patent No.: US 7,712,630 B2
(45) Date of Patent: May 11, 2010

(54) PIVOT MECHANISM FOR EJECTING A CIGARETTE CONTAINED IN A CIGARETTE CASE

(76) Inventor: Wen-Tian He, 4C. No. 2 Baihui Commerical Center, Songbaitang, Changping Town, Dongguan, Guangdong 523561 (CN)

( * ) Notice: Subject to any disclaimer, the term of this patent is extended or adjusted under 35 U.S.C. 154(b) by 512 days.

(21) Appl. No.: 11/705,039

(22) Filed: Feb. 19, 2007

(65) Prior Publication Data

US 2007/0246382 A1 Oct. 25, 2007

(30) Foreign Application Priority Data

Feb. 27, 2006 (CN) ..... 2006 1 0033984

(51) Int. Cl.
*B65H 3/08* (2006.01)
*B65G 59/00* (2006.01)

(52) U.S. Cl. ..... 221/248; 221/208; 221/279

(58) Field of Classification Search ..... 221/151, 221/152, 154, 185, 208, 209, 224, 226, 228–232, 221/234–238, 244–250, 259, 267, 268, 270–274, 221/279, 280, 282, 311
See application file for complete search history.

(56) References Cited

U.S. PATENT DOCUMENTS

| | | | | | |
|---|---|---|---|---|---|
| 21,770 | A * | 10/1858 | Platt | 221/141 |
| 930,301 | A * | 8/1909 | Mann | 221/249 |
| 1,071,629 | A * | 8/1913 | Shannon | 221/154 |
| 1,108,018 | A * | 8/1914 | Stiglich | 221/250 |
| 1,168,437 | A * | 1/1916 | Stone | 221/227 |
| 1,184,153 | A * | 5/1916 | Weisner | 221/248 |
| 1,226,591 | A * | 5/1917 | Primaver et al. | 221/248 |
| 1,321,453 | A * | 11/1919 | Johnson | 221/232 |
| 1,415,337 | A * | 5/1922 | Grover | 221/19 |
| 1,467,627 | A * | 9/1923 | Thimgren | 221/232 |
| 1,575,121 | A * | 3/1926 | Lyons | 221/232 |
| 1,656,060 | A * | 1/1928 | Glavey, Jr. | 221/141 |
| 1,692,545 | A * | 11/1928 | Carpenter | 221/98 |
| 1,825,805 | A * | 10/1931 | Markson | 221/230 |
| 1,943,678 | A * | 1/1934 | Keefe | 221/230 |
| 1,963,971 | A * | 6/1934 | Coon | 221/232 |
| 2,055,052 | A * | 9/1936 | Shaw et al. | 221/148 |
| 2,732,973 | A * | 1/1956 | Spector | 221/147 |
| 2,970,721 | A * | 2/1961 | Fontana | 221/227 |
| 3,101,157 | A * | 8/1963 | Russell | 221/227 |
| 7,207,463 | B1 * | 4/2007 | Balko | 221/249 |

* cited by examiner

*Primary Examiner*—Gene Crawford
*Assistant Examiner*—Kelvin L Randall, Jr.

(57) ABSTRACT

A cigarette case includes a cigarette casing including a corner outlet; a double-layer hinged cover including a first slit proximate the outlet and a second slit proximate the adjacent other corner; and a spring biased ejection means within the cover and including a pivotal L-shaped ejector, a pivotal trigger, a pivot bar, a link moveable in the first slit and including an end pusher extending through the first slit, the link having the other end pivotably secured to one portion of the ejector, and a sliding member moveable in the second slit and pivotably secured to the other end of the pivot bar, the sliding member including a door extending through the second slit to block the outlet when the case is closed. Pivoting the trigger will pivot the pivot bar to move the sliding member and the link to cause the pusher to eject a cigarette from the outlet.

2 Claims, 8 Drawing Sheets

PIVOT MECHANISM FOR EJECTING A CIGARETTE CONTAINED IN A CIGARETTE CASE

BACKGROUND OF THE INVENTION

1. Field of Invention

The invention relates to accessories for smoking tobacco and more particularly to a spring based pivot mechanism for ejecting a cigarette contained in a cigarette case.

2. Description of Related Art

Cigarette cases are well known devices. Typically, cigarettes are parallel arranged as one row or two vertical rows. It is often that the fingers taking out a cigarette may contact adjacent cigarettes (e.g., filter ends) unintentionally. This, however, may leave germs on the filter end and further spread germs on the filter end into the mouth while smoking. Hence, it is unsanitary.

There have been numerous suggestions in prior patents for cigarette cases having an automatic cigarette dispensing mechanism. For example, U.S. Pat. No. 5,265,717 discloses a cigarette case for automatically lighting and ejecting a cigarette contained therein. However, its mechanism incorporates many components including pivots, gears, carousel, springs, and electrical devices. Hence, it is relatively complex in constructions, costly to manufacture, trouble-prone, and unreliable in use.

Thus, it is desirable to provide a cigarette case having a simple mechanism for dispensing a cigarette contained therein in order to overcome the inadequacies of the prior art.

SUMMARY OF THE INVENTION

It is therefore one object of the invention to provide a spring based mechanism for ejecting a cigarette contained in a cigarette case by simply pivoting a trigger on a cover of the case.

The above and other objects, features and advantages of the invention will become apparent from the following detailed description taken with the accompanying drawings.

DETAILED DESCRIPTION OF THE INVENTION

Figure 1:
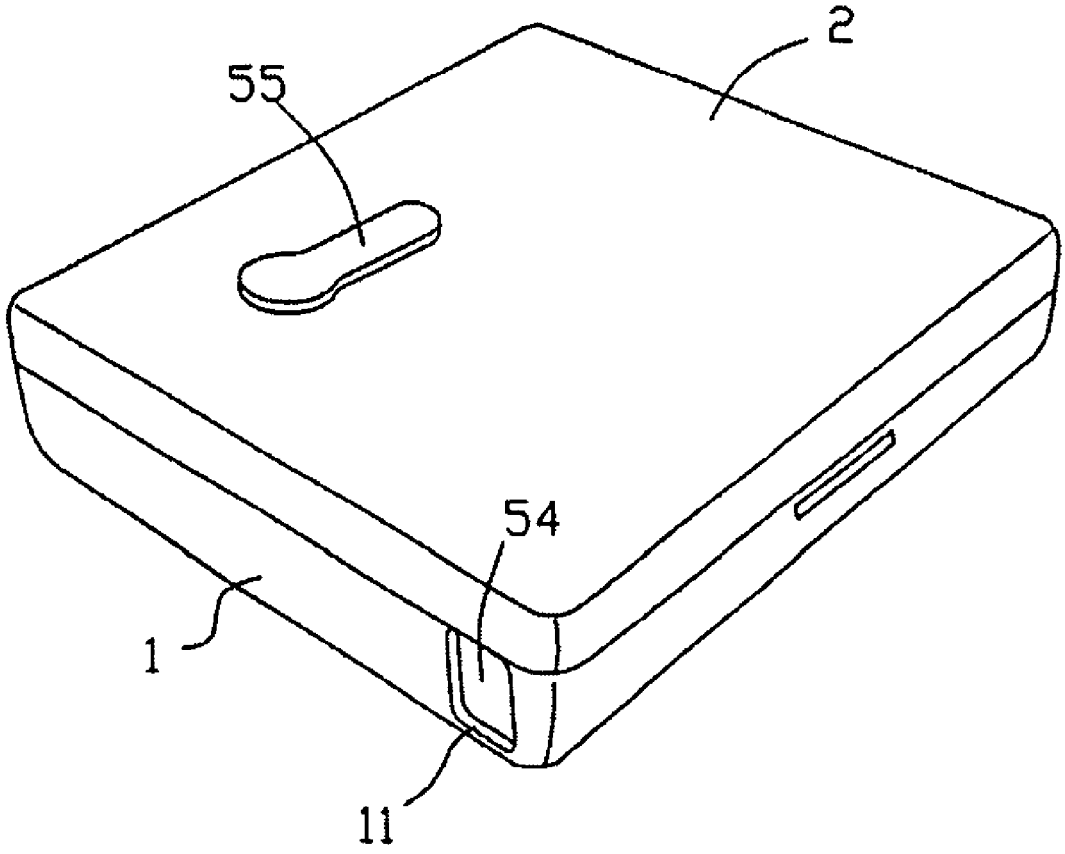
FIG. 1 is a perspective view of a cigarette case incorporating a cigarette ejecting mechanism according to the invention.
Figure 2:
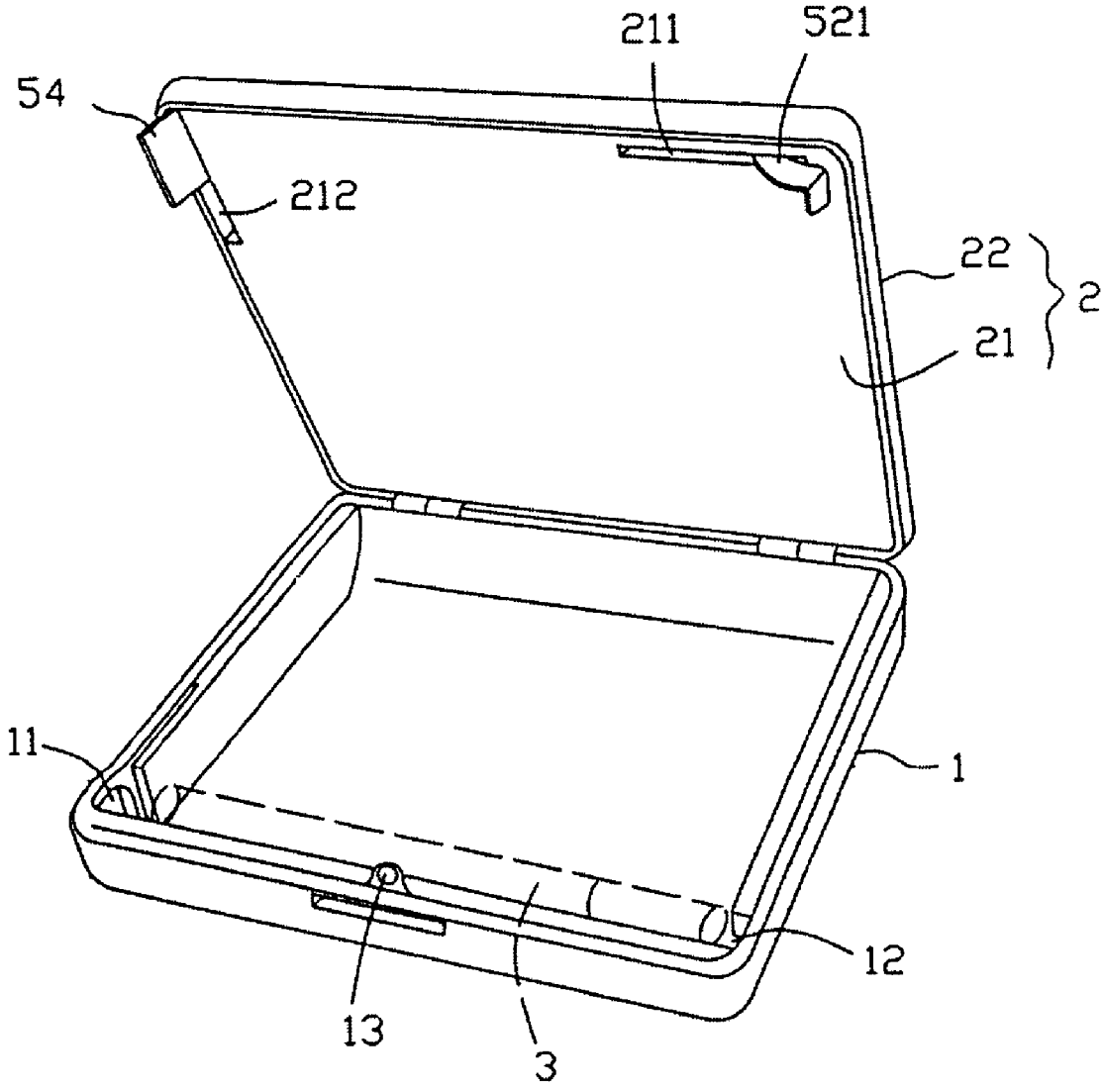
FIG. 2 is a perspective view of the open cigarette case.

Referring to FIGS. 1 to 4, a cigarette case incorporating a cigarette ejecting mechanism according to a first preferred embodiment of the invention is shown. The rectangular case comprises a casing 1 and a cover 2. The casing 1 comprises an internal space for containing a plurality of cigarettes (one is shown) 3, an outlet 11 at one corner, an elongate zone 12 straightly extending from the outlet 11 to the other corner of the same side with a single cigarette 3 rested thereon, and a clasp 13 provided at about a midpoint of the front end, the clasp 13 adapted to cooperate with a hole (not shown) at about a midpoint of the front end of the cover 2 for closing or opening the cigarette case as known in the art. The dimension of the outlet 11 is slightly larger than that of the cigarette 3 so as to not block the ejection of the cigarette 3 from the outlet 11.

The cover 2 comprises an outer covering plate 22 and an inner separation plate 21 including a narrow first channel 211 in proximity to the front end, and a narrow second channel 212 in proximity to one corner just above the outlet 11 when the case is closed.

The cigarette ejecting mechanism is mainly provided in a space defined by the covering plate 22 and the separation plate 21. The mechanism comprises an L-shaped ejector 50 pivotably secured to the covering plate 22, a trigger 55 fixed to a joining point of one portion of the ejector 50 and the other portion thereof and provided on a top of the covering plate 22, a pivot bar 51 pivotably secured to the covering plate 22 and having a downward extending peg 511 at one end, the peg 511 adapted to engage with one end of one portion of the ejector 50 as a stop in an inoperative position of the mechanism, a spring 53 in the form of a wire having one end secured to one end of the pivot bar 51 and the other end secured to one end of the other portion of the ejector 50, a link 52 having one end formed as a bent pusher 521 extending through the first channel 211 into a space defined by the casing 1 and the cover 2 in proximity to the other corner at the front end opposing the outlet 11, and the other end pivotably secured to one end of one portion of the ejector 50, and an elongate sliding member 54 having a lower portion extending through the second channel 212 into the space of the cigarette case to block the outlet 11 when the cigarette case is closed, and the remaining portion hidden in the space defined by the covering plate 22 and the separation plate 21, the sliding member 54 having its midpoint pivotably secured to the other end of the pivot bar 51, and the sliding member 54 adapted to move back and forth along the second channel 212 in cigarette ejecting operation as detailed later.

Figure 4:
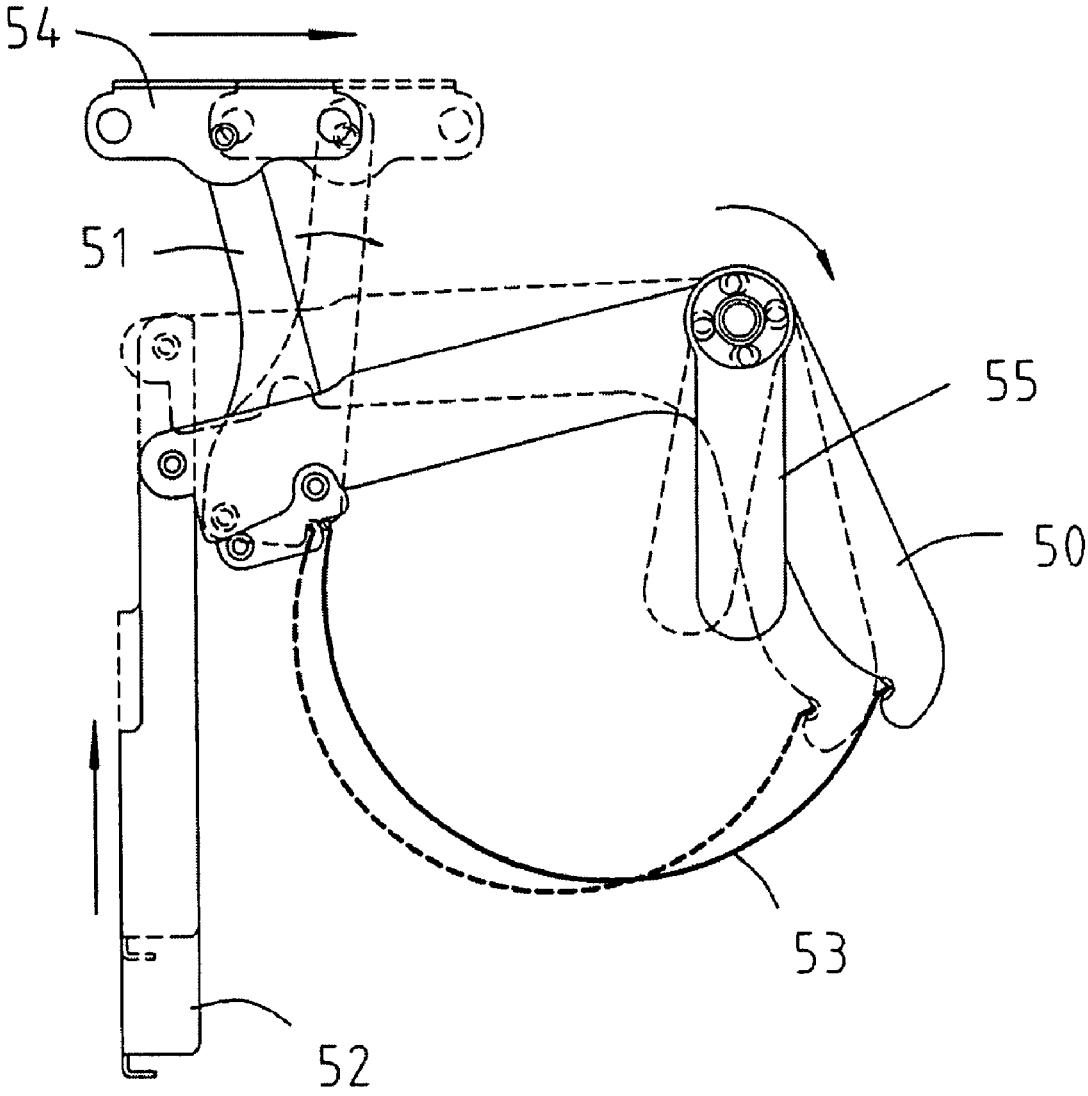
FIG. 4 is a top plan view of the mechanism of FIG. 3 showing a cigarette ejecting operation.

A cigarette ejecting operation of the invention will be described in detailed below by mainly referring to FIG. 4. A smoker may clockwise pivot the trigger 55 by pushing an end thereof. And in turn, the ejector 50 clockwise pivots. Also, the pivot bar 51 clockwise pivots about its pivot point at one end. Next, the sliding member 54 moves from one end of the second channel 212 toward the other end thereof to open the outlet 11. At the same time, the link 52 moves from one end of the first channel 211 toward the other end thereof to cause the pusher 521 to push the cigarette 3 outwardly. After the sliding member 54 reaching the other end of the second channel 212 and being stopped thereat, the link 52 continues to move and the spring 53 begins to compress because a distance between one end of the pivot bar 51 and one end of the other portion of the ejector 50 is decreased. The movement of the link 52 will be stopped when the link 52 has reached the other end of the first channel 211. At this position, the cigarette 3 has passed the outlet 11 to eject from the cigarette case. The cigarette ejecting operation thus ends.

A bottom of the casing 1 is inclined forward. That is, a rear portion of the bottom of the casing 1 has an elevation higher than that of a front portion thereof. This can automatically push an adjacent one of any remaining cigarettes 3 toward the empty zone 12 at the end of the cigarette ejecting operation. As a result, a cigarette 3 (if any) in the cigarette case is always disposed on the zone 12.

Figure 3:
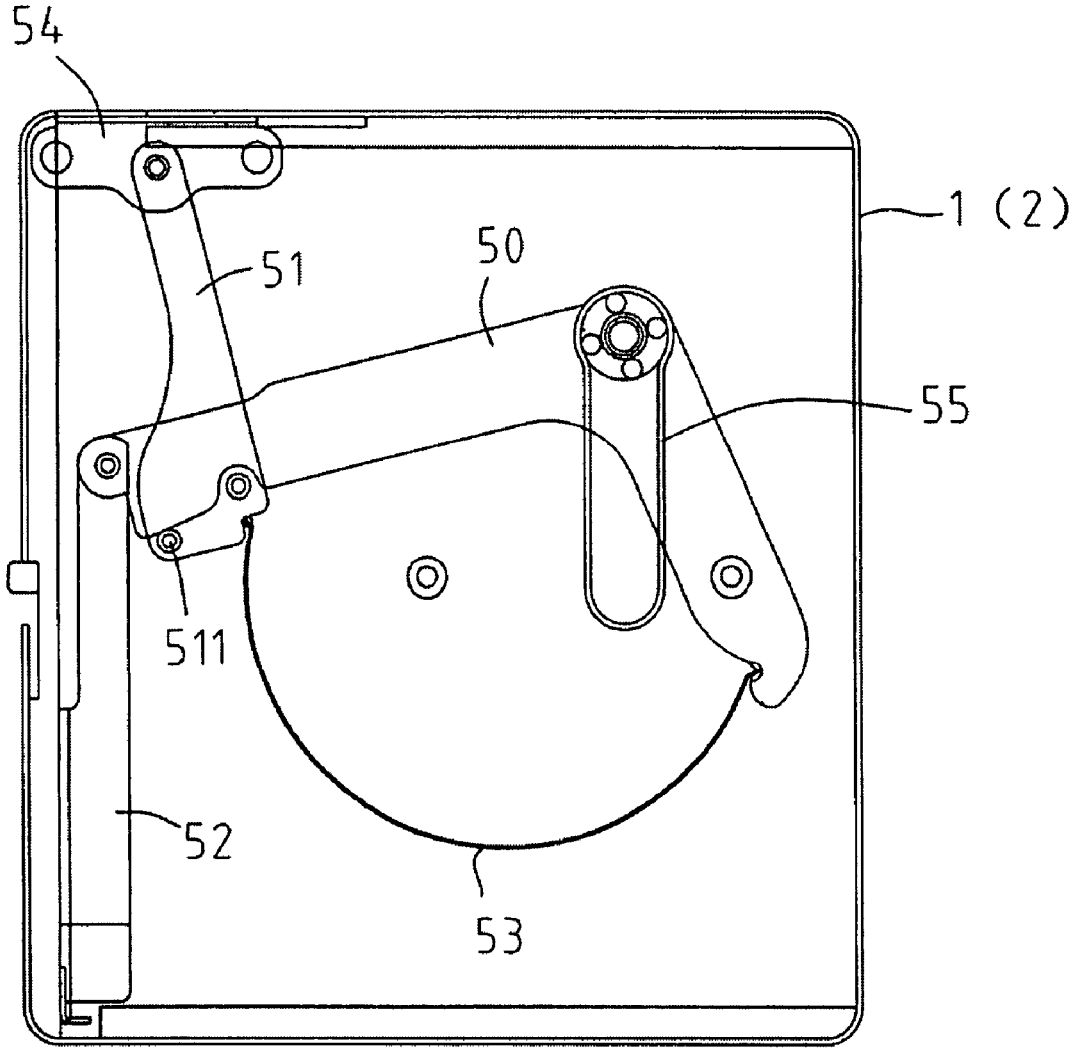
FIG. 3 is a top plan view of the cigarette case schematically depicting components of the mechanism according to a first preferred embodiment of the invention, where the mechanism is an inoperative position.

To the contrary, a releasing of the pivoting force exerted upon the trigger 55 will automatically return all components of the mechanism to their inoperative positions because the spring 53 exerts an expansion force to counterclockwise pivot the ejector 50 (see FIG. 3).

Figure 5:
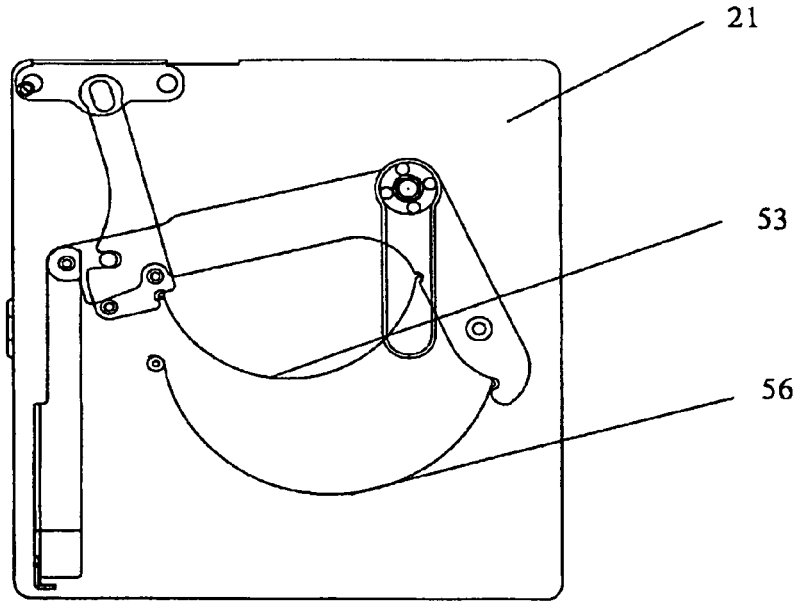
FIG. 5 is a top plan view of the cigarette case schematically depicting components of the mechanism according to a second preferred embodiment of the invention, where the mechanism is an inoperative position.
Figure 6:
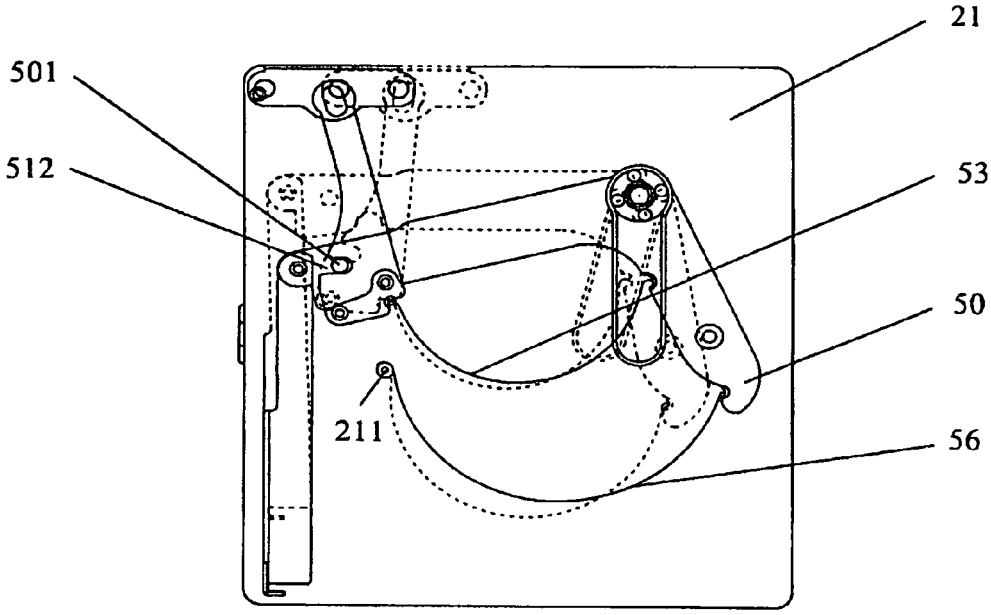
FIG. 6 is a view similar to FIG. 5 showing a cigarette ejecting operation.
Figure 7:
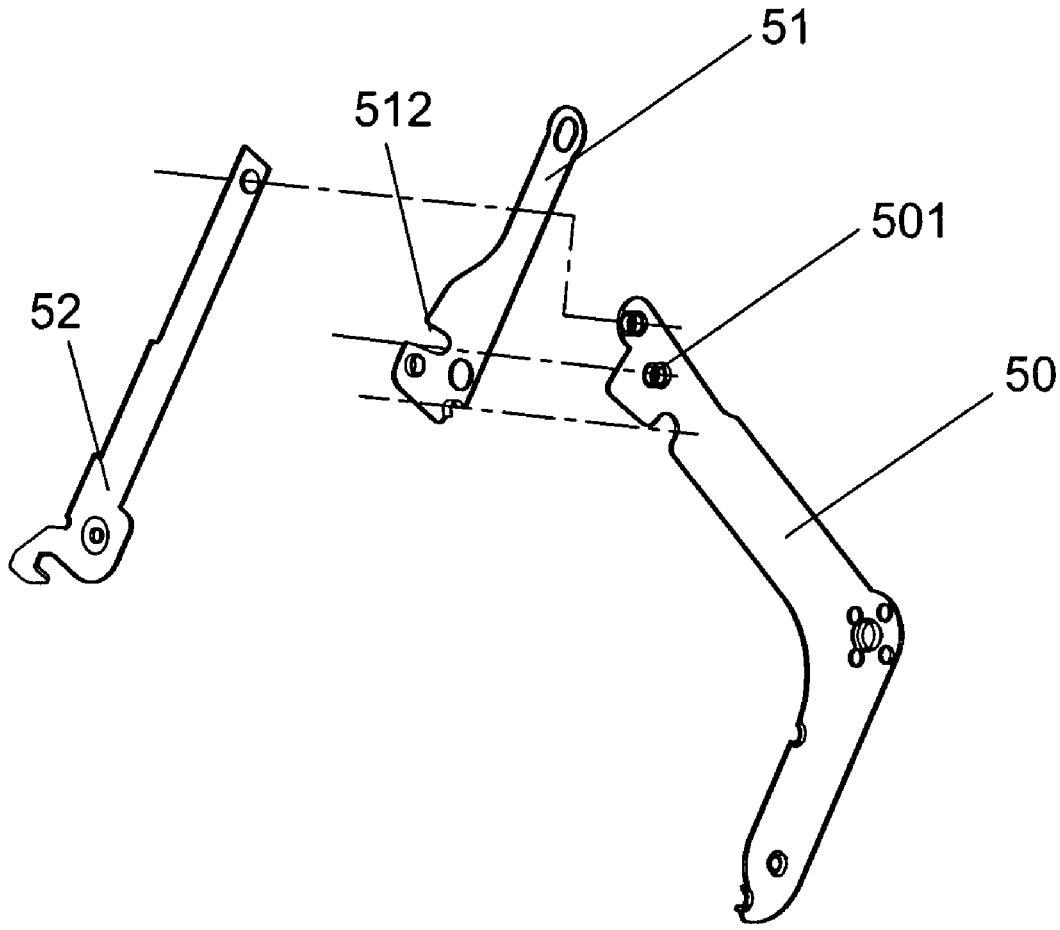
FIG. 7 is an exploded view of the ejector, the pivot bar, and the link of FIG. 5.

Referring to FIGS. 5, 6 and 7, a cigarette ejecting mechanism according to a second preferred embodiment of the invention is shown. The characteristics of the second preferred embodiment are detailed below. A first spring 53 in the form of a wire has one end secured to one end of the pivot bar 51 and the other end secured to about a midpoint of the other portion of the ejector 50. A second spring 56 in the form of a wire has one end secured to a post 211 fixedly mounted in the space defined by the covering plate and the separation plate 21 and the other end secured to one end of the other portion of the ejector 50. Both the springs 53 and 56 are compressed during the cigarette ejecting operation. The returning force after releasing the trigger 55 after the cigarette ejecting operation is thus further increased. The pivot bar 51 further comprises an arcuate cavity 512 at one end. A corresponding projection 501 is further provided at one end of one portion of the ejector 50. The projection 501 engages with the cavity 512 in the inoperative position of the mechanism as shown in solid lines in FIG. 5. The projection 501 disengages with the cavity 512 at the end of the cigarette ejecting operation as shown in phantom lines in FIG. 6. The provision of the projection 501 and the cavity 512 will ensure the engagement and disengagement of the pivot bar 51 and the pivot 50 to be more smooth and reliable.

Figure 8:
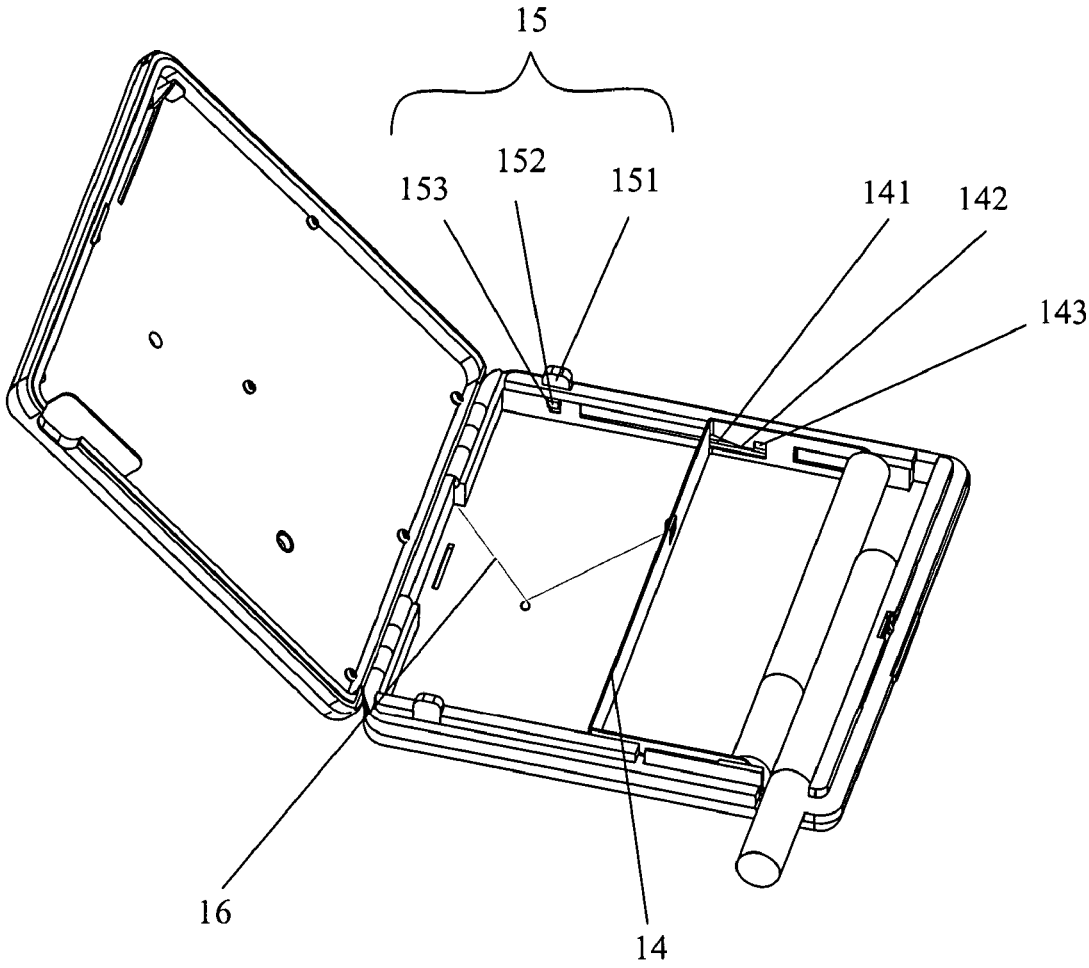
FIG. 8 is a perspective view of a cigarette case incorporating a cigarette ejecting mechanism according to a third preferred embodiment of the invention, where the cigarette case is open.

Referring to FIG. 8, a cigarette ejecting mechanism according to a third preferred embodiment of the invention is shown. The characteristics of the third preferred embodiment are detailed below. A U-shaped frame 14 is provided in the space defined by the casing. The frame 14 has both sides disposed in proximity to both sides of the casing. A V-shaped elastic member 16 has one end secured to an intermediate portion of the rear end of the casing and the other end secured to an intermediate portion of the main portion of the frame 14. Thus, the frame 14 is adapted to slide back and force in the casing. A plurality of cigarettes can be stored in a space defined by the frame 14, both sides of the casing, and the front end of the casing. A locking device 15 is provided at a rear portion of either side of the casing. The locking device 15 comprises a button 151 upwardly projecting from the side of the casing, a latch 152 formed with the button 151 laterally projecting into a space defined by the casing, and a spring 153 having one end secured to an internal member of the side of the casing and the other end secured to a joining portion of the latch 152 and the button 151. Thus, both the latch 152 and the button 151 are spring biased members. At either corner of the frame 14 there are provided a recess 141 open to the rear end of the casing, a slot 143 at a blind end of the recess 141, and a ramp 142 extending from the slot 143 to the mouth of the recess 141.

A cigarette loading and ejecting operation of the mechanism will be described in detailed below. First, a smoker may push the frame 14 toward the rear end of the casing by compressing the elastic member 16 until the latch 152 enters the recess 141 and passes the ramp 142 into the slot 143 for being locked therein. Next, the smoker may put a plurality of cigarettes into the space defined by the frame 14 and the casing. Next, close the cover onto the casing after loading the cigarettes. The spring 153 is thus compressed because the bottom of the cover presses the button 151 and the latch 152 thus retracts outward to clear the slot 143. Hence, the frame 14 is unlocked. The frame 14, as always pushed by the force exerted thereon by the elastic member 16, will automatically push an adjacent cigarette to occupy the empty space left by the cigarette which has been ejected from the cigarette case at the end of the cigarette ejecting operation as described above.

Figure 9:
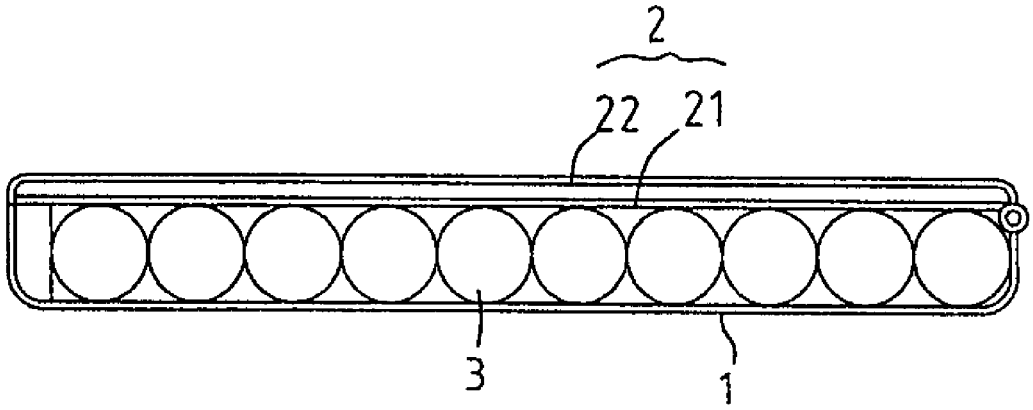
FIGS. 9 and 10 are side elevations of a first cigarette case according to the invention having cigarettes arranged parallel as one row and a second cigarette case according to the invention having cigarettes arranged parallel as two vertical rows respectively.
Figure 10:
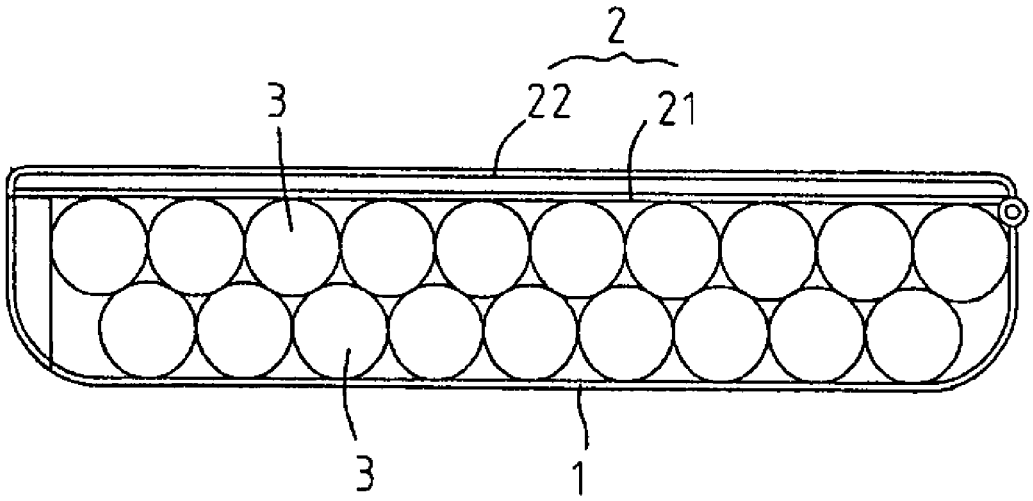

Referring to FIG. 9, a plurality of cigarettes 3 can be arranged parallel as a single row in a smaller cigarette case. Referring to FIG. 10, a plurality of cigarettes 3 can be arranged parallel as two vertical rows in a larger cigarette case.

While the invention herein disclosed has been described by means of specific 25, embodiments, numerous modifications and variations could be made thereto by those skilled in the art without departing from the scope and spirit of the invention set forth in the claims.

What is claimed is:

1. A cigarette case comprising:

a casing for containing a plurality of cigarettes arranged parallel in a row and including a front end having two corners and an outlet at one corner of the front end, wherein a bottom of the casing is inclined forward;

a cover having a rear end hingedly connected to the casing and including an outer covering plate and an inner separation plate including a first slit in proximity to the outlet when the cigarette case is closed, the first slit having two ends, and a second slit in proximity to the other corner of the front end of the casing and having two ends; and ejection means mounted in a first space defined by the covering plate and the separation plate and including an L-shaped ejector pivotably secured to the covering plate, the elector having two portions, a trigger fixed to a joining point of one portion of the ejector and the other portion of the ejector, the trigger being pivotably mounted on a top of the covering plate, a pivot bar having two ends, the pivot bar pivotably secured to the covering plate and including a downward extending stop member at one end, the stop member being adapted to engage with one end of one portion of the ejector in an inoperative position of the ejection means, a first elastic member interconnecting one end of the pivot bar and a first position of the other portion of the ejector, a link moveably mounted in the first slit and having two ends, the link including a bent pusher at one end, the pusher extending through the first slit into a second space defined by the casing and the separation plate, the other end of the link pivotably secured to one end of one portion of the ejector, and a sliding member moveably mounted in the second slit and pivotably secured to the other end of the pivot bar, the sliding member including a door extending through the second slit into the second space to block the outlet when the cigarette case is closed, whereby clockwise pivoting the trigger will pivot the pivot bar to move the sliding member from one end of the second slit to the other end of the second slit to open the outlet, move the link from one end of the first slit to the other end of the first slit to cause the pusher to eject a portion of the cigarette aligned with the outlet from the outlet, and compress the first elastic member after the sliding member reaching the other end of the second slit.

2. A cigarette case comprising:

a casing including two sides, a front end having two corners, an outlet at one corner of the front end, and a locking unit at a rear portion of either side of the casing, the locking unit including a spring biased button upwardly projecting, the button including a latch laterally projecting into a first space defined by the casing;

a cover having a rear end hingedly connected to the casing and including an outer covering plate and an inner separation plate including a first slit in proximity to the outlet when the cigarette case is closed, the first slit having two ends, and a second slit in proximity to the other corner of the front end of the casing and having two ends;

a U-shaped frame mounted in the first space and having two sides in proximity to both sides of the casing, the frame including a resilient member extending to connect to a rear end of the casing, and two locking members at both corners, each locking member including a recess and a slot at a blind end of the recess; and ejection means mounted in a second space defined by the covering plate and the separation plate and including an L-shaped ejector pivotably secured to the covering plate, the ejector having two portions, a trigger fixed to a joining point of one portion of the ejector and the other portion of the ejector, the trigger being pivotably mounted on a top of the covering plate, a pivot bar having two ends, the pivot bar pivotably secured to the covering plate and including a downward extending stop member at one end, the stop member being adapted to engage with one end of one portion of the ejector in an inoperative position of the ejection means, a first elastic member interconnecting one end of the pivot bar and a first position of the other portion of the ejector, a link moveably mounted in the first slit and having two ends, the link including a bent pusher at one end, the pusher extending through the first slit into the first space, the other end of the link pivotably secured to one end of one portion of the ejector, and a sliding member moveably mounted in the second slit and pivotably secured to the other end of the pivot bar, the sliding member including a door extending through the second slit into the first space to block the outlet when the cigarette case is closed, wherein a plurality of parallel cigarettes are adapted to store in a portion of the first space between the frame and the front end of the casing in response to pushing the frame toward the rear end of the casing by compressing the resilient member until the latch enters the recess to lockingly engage with the slot;

wherein the cover is adapted to close onto the casing to depress the button and retract the latch outward to clear the slot; and wherein in response to clockwise pivoting the trigger, the pivot bar pivots to move the sliding member from one end of the second slit to the other end of the second slit to open the outlet, the link moves from one end of the first slit to the other end of the first slit to cause the pusher to eject a portion of the cigarette aligned with the outlet from the outlet, and the first elastic member compresses after the sliding member reaching the other end of the second slit.

* * * * *